United States Patent [19]

de Barros

[11] 4,094,570

[45] June 13, 1978

[54] ELECTRICAL CONNECTOR

[75] Inventor: Ruy F. M. de Barros, Woluwe-St-Lambert, Belgium

[73] Assignee: Societe Anonyme belge d'exploitation de la navigation aerienne (SABENA), Belgium

[21] Appl. No.: 776,781

[22] Filed: Mar. 11, 1977

[30] Foreign Application Priority Data

Nov. 19, 1976 Belgium ..... 172530

[51] Int. Cl.[2] ..... H01R 13/62

[52] U.S. Cl. ..... 339/75 M

[58] Field of Search ..... 339/75 R, 75 M, 75 MP, 339/91 R

[56] References Cited

U.S. PATENT DOCUMENTS

| | | | |
|---|---|---|---|
| 3,489,986 | 1/1970 | Frederick | 339/75 M X |
| 3,601,759 | 8/1971 | Barker | 339/75 MP X |

*Primary Examiner*—Roy Lake
*Assistant Examiner*—E. F. Desmond
*Attorney, Agent, or Firm*—Hill, Gross, Simpson, Van Santen, Steadman, Chiara & Simpson

[57] ABSTRACT

An electric connector is described comprising two units having an elongated shape, each unit having a plurality of contact means fixed each at one end of a flexible strip the other end of which is fixed to a respective unit, each strip extending transversely to the lengthwise direction of the respective unit. Pressure means are provided on one of the units and blocking means are provided on the other unit, said pressure and blocking means being arranged for cooperating together such that when the two units are engaged one into the other, the blocking means urge the pressure means to cause same to apply to the set of contiguous contact means a pressure in the lengthwise direction of the units, whereby the contact means form a rigid assembly.

11 Claims, 8 Drawing Figures

ELECTRICAL CONNECTOR

The present invention relates to a novel electric connector.

The conventional electric connectors comprise two separate blocks of insulating material having each a set of contact means embedded therein. In these connectors the connection function between pairs of contact means is based uniquely on the spring stress of the contact means upon each other, whereas their alignment depends substantially on the alignment of the two insulating blocks with each other so that there is no guaranty that all the contacts are effectively made when the two insulating blocks are engaged one into the other. That is to say that the conventional connectors do not permit the user to supervise the effectiveness of the connections between the contact means.

From the foregoing it is apparent that the conventional connectors do not prevent permanent or intermittent breakings of the contact means to occur, they are sensitive to vibration and their contact means are subject to permanent deformations. Furthermore, these connectors are manufactured in a number of standardized models having each a fixed number of contact means and consequently they are often not quite adaptable to the electric and/or electronic assemblies. In summary, the conventional connectors suffer substantially of several faults: misalignment of the contact means, false electrical connections, sensitivity to vibration.

The object of the invention is an electric connector which is adaptable to the electric and electronic assemblies comprising panels, printed circuit boards or any other type of components which are to be interconnected.

According to the invention there is provided an electric connector comprising first and second support means having an elongated shape, first and second sets of contact means arranged in at least one layer extending in a plane parallel to the lengthwise direction of a respective support means, each contact means of each set being fixed at the end of a flexible strip having its other end fixed to the respective support means, each strip extending transversely to the lengthwise direction of the support means, each blade being arranged to allow it to bend in the plane of the respective layer of contact means, the said contact means of both sets being arranged to alternate with each other when the two sets are engaged one into the other, said contact means having an insulating element such that each contact means of one set electrically cooperates with one contact means of the other set; at least one pressure means on the first support means extending transversely to the lengthwise direction of the support means, said pressure means having at least one face perpendicular to the plane of the said at least one layer of contact means, oblique to the lengthwise direction of the support means; and at least one blocking means on the second support means, said blocking means having at least one surface arranged to cooperate with the said face of the pressure means thereby to apply to the contiguous alternate contact means when the two sets of contact means engage one into the other, a pressure in the lengthwise direction of the support means.

In the drawings

Figure 1:
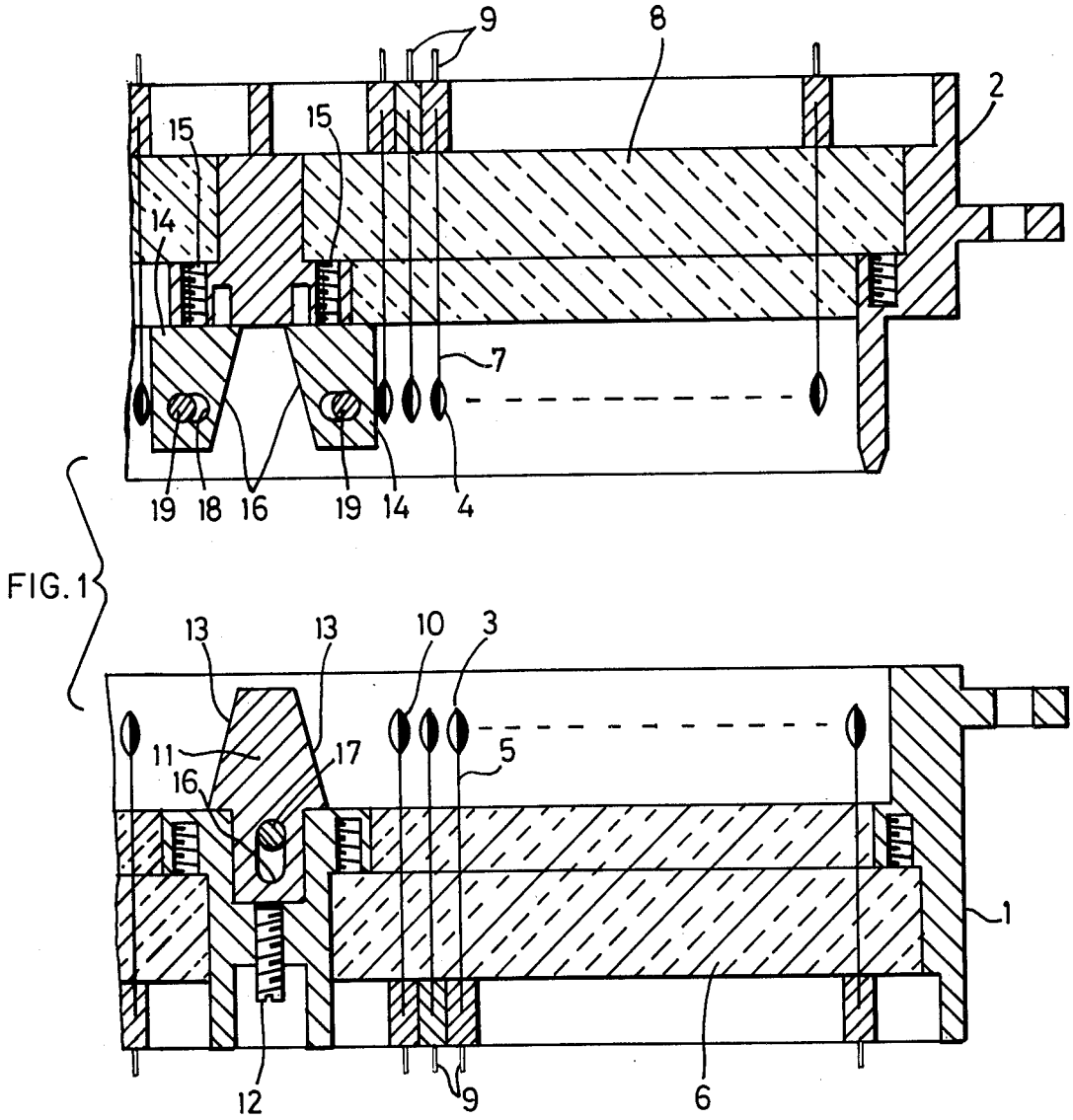
FIG. 1 is a lengthwise sectional view of a first embodiment showing the two units comprising the connector in non-engaged relationship.

Referring to FIG. 1 there is shown a connector comprising two elongated units 1 and 2, each having a set of contact means 3 and 4 respectively. The contact means in each set may be arranged in one or several parallel layers. Unit 1 can be mounted for instance along the edge of a printed circuit board or a panel containing printed circuit boards; unit 2 is then to be mounted on a rack.

In each of said sets of contact means 3 and 4, each contact means is fixed at the end of a flexible electroconducting strip which extends transversely to the lengthwise direction of the unit, each being arranged such that it can bend in the lengthwise direction of the unit. Specifically, each contact means 3 is fixed at the free end of a flexible strip 5 the other end of which is fixed in a support element 6 made of insulating material. Similarly, each contact means 4 is fixed at the free end of a flexible strip 7 having its other end fixed in a support element 8 made of insulating material. The fixed ends of the flexible strips are so arranged as to permit electrical conductors 9 to be connected thereto.

Figure 2:
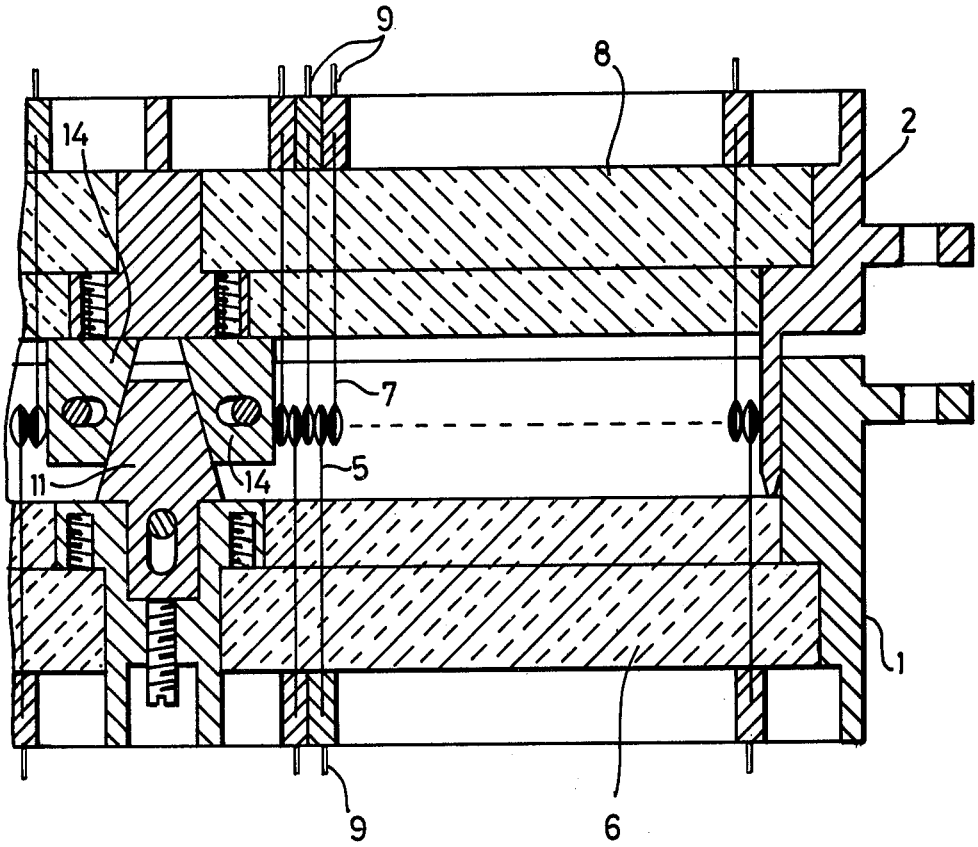
FIG. 2 is a lengthwise sectional view of a first embodiment showing the two units engaged one into the other.
Figure 3:
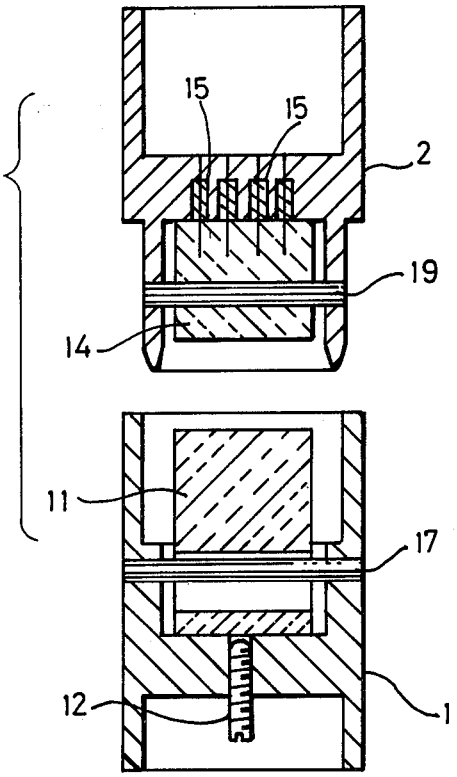
FIG. 3 is a sectional view along line III—III of FIG. 1.

The flexible strips are arranged along the lengthwise direction of the support elements 6 and 8 such that when the units 1 and 2 are joined and engaged one into the other as shown in FIG. 2, the contact means 3 and 4 are placed side by side in alternate relationship. Each contact means in at least one of the sets of contact means has a lateral face covered with an insulating element 10 whereby each contact means 3 electrically cooperates with one and only one contact means 4.

The support element 6 is provided in the central portion thereof with a pressure means or actuator means comprising a block 11 of insulating material mounted on a rod 12 extending perpendicularly to the lengthwise direction of unit 1. The block 11 has two faces 13 which are oblique to the engaging direction of the units 1 and 2 one into the other i.e. the direction perpendicular to the lengthwise direction of unit 1.

The support element 8 is provided with a blocking means or slidable means 14 made of insulating material. In the embodiment shown in FIGS. 1 and 2, the blocking means comprises two blocks mounted on rods 15. The blocks 14 each have a face 16 adapted to cooperate with a face 13 of pressure or actuator means 11 when the latter is inserted between the two blocks 14. Thus, as units 1 and 2 are moved towards each other such that the contact means 3 and 4 are brought side by side, said pressure or actuator means 11 is secured between the two blocks 14 and presses upon the latters in the lengthwise direction of units 1 and 2 whereby a pressure is applied upon the two groups of alternate contact means 3 and 4 such that the latters form a rigid assembly which is insensitive to vibration and where the contact means are squeezed and locked together.

To allow the blocking pressure upon the contact means to be adjusted the rods 12 and 15 are threaded and the said adjustment can be made by simply screwing the rods in their housing.

As shown in FIGS. 1 and 2, the pressure means 11 may be provided with an eye 16 to permit a rod 17 to pass therethrough. The assembly 16–17 serves as guiding means for the pressure means 11 when the position thereof is being adjusted. Similarly, the blocks 14 may be provided with eyes 18 to permit rods 19 to pass therethrough for serving as guiding means for the blocks 14 when the latters are caused to press upon the contact means.

According to the invention the cooperating faces of the pressure means 11 and the blocking means 14 are so inclined that the cooperating faces of the contact means are moved progressively towards each other during the engaging operation of units 1 and 2 one into the other. Such a movement causes the contact surfaces to be automatically cleaned off. FIG. 4 illustrates how the engaging operation proceeds. Four typical steps are schematically depicted for two pairs of contact means 31, 41 and 32, 42 which are moved toward each other in the directions shown by arrows I and II.

Figure 4A:
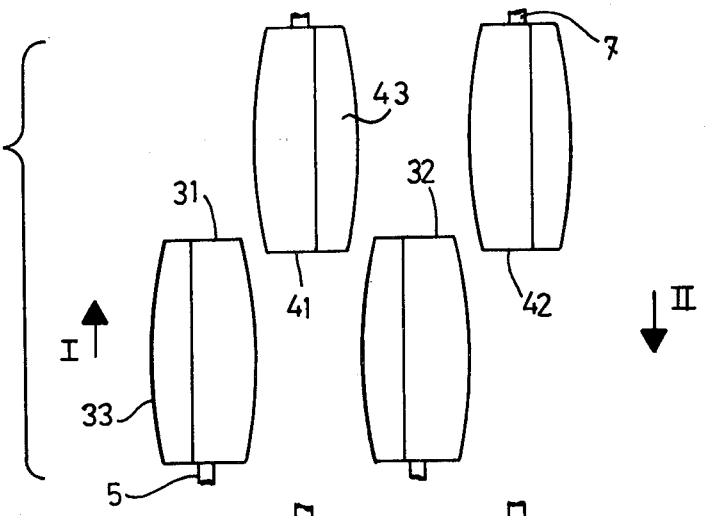
FIG. 4 shows four sketches illustrating the engaging process of the contact means between one another.
Figure 4B:
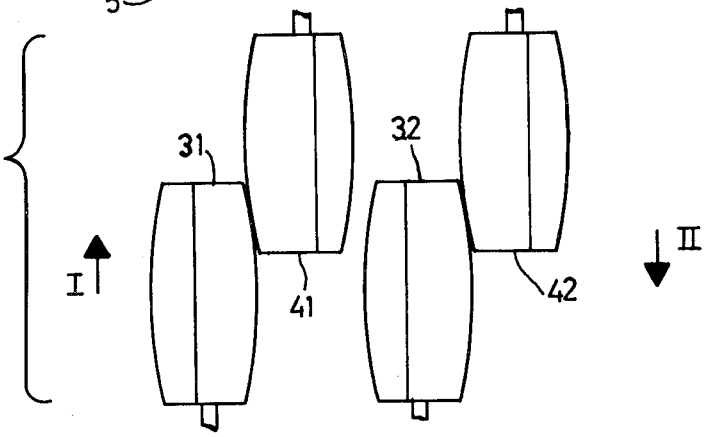
Figure 4C:
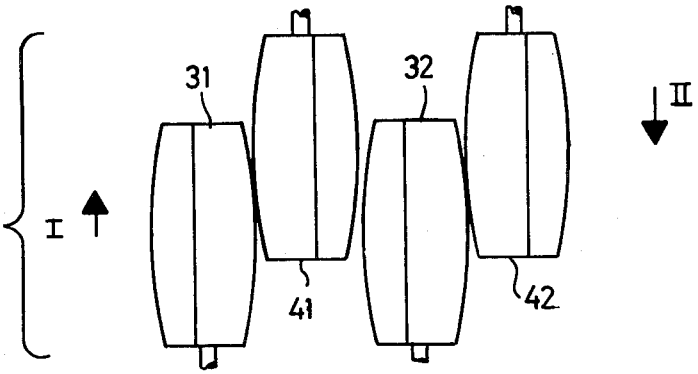
Figure 4D:
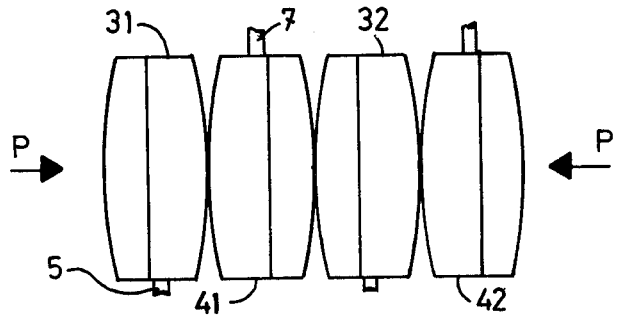

On the drawing the references 33 and 43 identify an insulating material. FIG. 4A shows the contact means 31 and 32 out of contact from contact means 41 and 42. FIG. 4B shows the step when the surfaces of contact means 31 and 32 make a first contact with the surfaces of contact means 41 and 42. When proceeding further in the directions of arrows I and II, the contact surfaces slide one on the other whereby said surfaces are cleaned by their sliding friction. This sliding motion of the contact means along their surfaces is facilitated by the flexibility of the spring strips which are allowed to bend transversaly to the direction of moving of the units 1 and 2. FIG. 4D shows the two pairs of contact means fully engaged into each other such that contact means 31 is in electrical contact with contact means 41 and contact means 32 is in electrical contact with means 42. The assembly of contiguous contact means is made rigid by the pressure action applied by the blocking means such as 14 in FIGS. 1 and 2 in the direction of arrows P.

Figure 5:
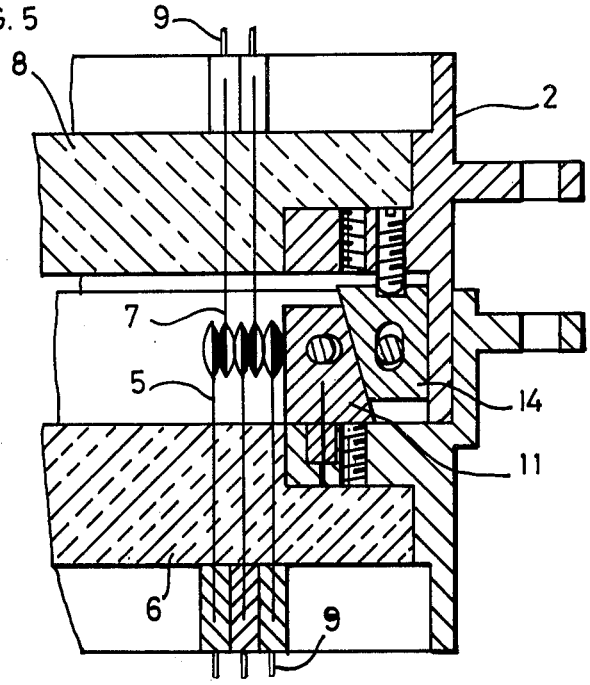
FIG. 5 is a lengthwise sectional view of a portion of another embodiment showing the two units engaged one into the other.

In the embodiment depicted in FIGS. 1 and 2 the pressure means 11 and blocking means 14 are provided in the central portion of units 1 and 2, thereby to separate the contact means in two distinct groups. It will be obvious that a plurality of blocks 11 and 14 may be provided along the lengthwise direction of units 1 and 2 thereby the separate the contact means in a plurality of distinct groups. In another embodiment the pressure and blocking means may be provided at the ends of units 1 and 2 as depicted by way of example in FIG. 5. The components shown in this figure are the same as in FIGS. 1 and 2, and therefore this embodiment does not call any description. It will merely be noted that the blocking means 14 comprises one block only since the pressure means 11 is situated at one end of unit 1 and since consequently the pressure and blocking means each have only one oblique contact face.

What is claimed is:

1. An electric connector comprising first and second support means having an elongated shape, first and second sets of contact means arranged in at least one layer extending in a plane parallel to the lengthwise direction of a respective support means, each contact means of each set being fixed at one end of a flexible strip having its other end fixed to the respective support means, each strip extending transversely to the lengthwise direction of the support means, each strip being arranged to allow it to bend in the plane of the respective layer of contact means, the said contact means of both sets being arranged to be in an alternating relationship and insulated one from the other when the two sets are engaged one into the other, said contact means having an insulating element such that each contact means of one set electrically cooperates with one contact means of the other set; at least one pressure means on the first support means extending transversely to the lengthwise direction of the support means, said pressure means having at least one face oblique to the lengthwise direction of the support means; and at least one blocking means on the second support means and being mounted for longitudinal movement relative to said second support means, said blocking means having at least one surface arranged to cooperate with the said face of the pressure means thereby to apply force to the contiguous alternate contact means when the two sets of contact means engage one into the other so that transverse mating engagement of one support means with the other produces a pressure in the lengthwise direction of the support means and against said contact means to cause said contact means on the ends of said flexible strips to be directly physically engaged together in vibration-free relation.

2. The connector of claim 1 further characterized by stationary backup means being provided for said contact means abutting one end of one of said support means in response to being moved by said slidable means thus permitting the contact means to be squeezed and locked together between said slidable means and said backup means upon actuation of said slidable means as the support means are mated together.

3. An electric connector comprising first and second support means having an elongated shape, first and second sets of contact means arranged in at least one layer extending in a plane parallel to the lengthwise direction of a respective support means, each contact means of each set being fixed at one end of a flexible strip having its other end fixed to the respective support means, each strip extending transversely to the lengthwise direction of the support means, each strip being arranged to allow it to bend in the plane of the respective layer of contact means, the said contact means of both sets being arranged to be in an alternating relationship when the two sets are engaged one into the other; at least one pressure means on the first support means extending transversely to the lengthwise direction of the support means, said pressure means having at least one face oblique to the lengthwise direction of the support means; and at least one blocking means on the second support means and being mounted for longitudinal movement relative to said second support means, said blocking means having at least one surface arranged to cooperate with the said face of the pressure means thereby to apply force to the contiguous alternate contact means when the two sets of contact means engage one into the other so that transverse mating engagement of one support means with the other produces a pressure in the lengthwise direction of the support means and against said contact means to cause said contact means on the ends of said flexible strips to be directly physically engaged together in vibration-free relation.

4. An electric connector according to claim 3, wherein each pressure means comprises means for adjusting the position thereof relative to the respective support means.

5. An electric connector according to claim 3, wherein each pressure means comprises means for guiding the said pressure means when the position thereof is being adjusted.

6. An electric connector according to claim 3, wherein each blocking means comprises means for adjusting the position thereof relative to the respective support means.

7. An electric connector according to claim 3, wherein each blocking means comprises means for guiding the said blocking means when the position thereof is being adjusted.

8. An electric connector according to claim 3, wherein at least one pressure means comprises a block of insulating material provided in the central portion of the respective support means, said block having two faces perpendicular to the plane of the layer of contact means.

9. An electric connector according to claim 8, wherein at least one blocking means comprises two blocks of insulating material provided in the central portion of the respective support means, said blocking means having two surfaces arranged to cooperate with the oblique faces of a pressure means.

10. An electric connector according to claim 3, comprising a pressure means at each end of the respective support means, said pressure means having a face oblique to the lengthwise direction of the support means.

11. An electric connector according to claim 10, comprising a blocking means at each end of the respective support means, said blocking means having a surface arranged to cooperate with the said oblique face of a respective pressure means.

* * * * *

UNITED STATES PATENT AND TRADEMARK OFFICE

CERTIFICATE OF CORRECTION

PATENT NO. : 4,094,570

DATED : June 13, 1978

INVENTOR(S) : Ruy F.M. de Barros

It is certified that error appears in the above-identified patent and that said Letters Patent are hereby corrected as shown below:

Col. 3, line 62, cancel, beginning with "1. An electric connector" to and including "vibration-free relation." in Col. 4, line 27, and insert the following:

--1. An electric connector comprising first and second support means having an elongated shape, first and second sets of contact means arranged in at least one layer extending in a plane parallel to the lengthwise direction of a respective support means, each contact means of each set being fixed at one outer end of a flexible strip having its other end fixed to the respective support means, each strip extending transversely to the lengthwise direction of the support means, each strip being arranged to allow it to bend in the plane of the respective layer of contact means, the said contact means of both sets being arranged to be in an alternating relationship when the two sets are engaged one into the other, said contact means having an insulating element such that each contact means of one set electrically cooperates with one contact means of the other set; slidable means slidably mounted on one of said first and second support means for direct engagement with said contact means for causing said contact means to longitudinally move on said flexible strips and to engage one another in direct locked vibration-free engagement together, and actuator means on another of said first and second means for actuating said slidable means as said first and second support means are in transversely mated engagement producing a pressure in the lengthwise direction of the support means thus effecting inter-engagement of said first and second sets of contact means.--

UNITED STATES PATENT AND TRADEMARK OFFICE

CERTIFICATE OF CORRECTION

PATENT NO. : 4,094,570

DATED : June 13, 1978

INVENTOR(S) : Ruy F.M. de Barros

Sheet 2 of 2

It is certified that error appears in the above-identified patent and that said Letters Patent are hereby corrected as shown below:

Col. 4, line 48, after "ship" insert --and insulated one from the other--; and, Col. 4, line 48, after "other" insert —, said contact means having an insulating element such that each contact means of one set electrically cooperates with one contact means of the other set--.

Signed and Sealed this

Seventh Day of June, 1988

*Attest:*

DONALD J. QUIGG

*Attesting Officer*

*Commissioner of Patents and Trademarks*